US005223358A

United States Patent [19]

Yamada et al.

[11] Patent Number: 5,223,358

[45] Date of Patent: Jun. 29, 1993

[54] FLUORORESIN-COATED MATERIAL HAVING MARKINGS INDICATED THEREON

[75] Inventors: Katsuya Yamada; Masahiro Morita; Nobutaka Matsushita; Yoshichika Nishimura; Fumio Matsuyama, all of Osaka, Japan

[73] Assignee: Sumitomo Electric Industries, Ltd., Osaka, Japan

[21] Appl. No.: 620,112

[22] Filed: Nov. 30, 1990

[30] Foreign Application Priority Data

Nov. 30, 1989 [JP] Japan ..... 1-312807
Jan. 11, 1990 [JP] Japan ..... 2-5512
Aug. 23, 1990 [JP] Japan ..... 2-223745

[51] Int. Cl.[5] ..... G03C 1/73

[52] U.S. Cl. ..... 430/18; 430/292; 430/346; 430/495; 430/945; 430/962; 430/273; 430/342

[58] Field of Search ..... 430/495, 346, 342, 270, 430/962, 18, 17, 9, 273, 945, 332; 292

[56] References Cited

U.S. PATENT DOCUMENTS 3,694,208 9/1972 Ranz et al. ..... 430/292
4,365,012 12/1982 Hocker et al. ..... 430/19
4,654,290 1/1986 Spanjer ..... 430/138
4,711,834 12/1987 Butters et al. ..... 430/201
4,959,406 9/1990 Foltin et al. ..... 524/413
5,009,959 4/1991 Matsushita et al. ..... 428/419
5,063,137 11/1991 Kiyonari et al. ..... 430/292
5,091,284 2/1992 Bradfield ..... 430/292
5,114,826 5/1992 Kwong et al. ..... 430/192

FOREIGN PATENT DOCUMENTS 1-215589 8/1989 Japan ..... 430/945

*Primary Examiner*—Charles L. Bowers, Jr.
*Assistant Examiner*—John A. McPherson
*Attorney, Agent, or Firm*—Sughrue, Mion, Zinn, Macpeak & Seas

[57] ABSTRACT

A fluororesin-coated material having markings indicated thereon is disclosed, which material comprises (1) a substrate having coated thereon a fluororesin composition comprising a high-molecular weight material having a benzene ring and at least one of a nitrogen atom, a sulfur atom and a carbonyl group in the main chain thereof, or (2) a substrate having coated thereon the high-molecular weight material, and further having coated on the high-molecular weight material a fluororesin composition. The markings are indicated on the coated material by irradiating the coated surface of the coated material with electromagnetic waves having a wavelength of 600 nm or less to thereby cause a change in the color of the high-molecular weight material at irradiated parts and provide a difference in color between the irradiated parts and unirradiated parts.

11 Claims, 1 Drawing Sheet

FLUORORESIN-COATED MATERIAL HAVING MARKINGS INDICATED THEREON

FIELD OF THE INVENTION

The present invention relates to a fluororesin-coated material having markings, such as scales, patterns, letters, etc., indicated thereon. More particularly, it relates to a fluororesin-coated material having markings, such as scales, patterns, letters, etc., which are indicated thereon by irradiating the fluororesin-coated material with electromagnetic waves to thereby cause a change in the color of a high-molecular weight material which is contained in or laminated with a fluororesin composition.

BACKGROUND OF THE INVENTION

As a means for providing the indications of scale, etc. on fluororesin-coated materials, there are conventionally only means which utilize the shadow of recesses and protrusions physically formed by pressing the coated materials, that is, only means using press-markings.

This is because fluororesins are non-tacky and hence indications such as scale, etc. are difficult to be provided on the surfaces thereof by printing. Even if printing could be made, the non-tacky property of the printed parts would be lowered. Accordingly, when they are used in the field of kitchen utensils such as inner pots of rice cookers, undesirable phenomenon occurs in that rice sticks onto the printed parts.

For this reason, indications on kitchen utensils such as pots of rice cookers have been entirely made by press-markings. However, these means have serious problems.

Firstly, the press-marked parts of coated materials are deformed by a very high curvature and fluororesin coatings are thus stretched so that the coatings are liable to be peeled off from the substrate at the interfaces, and/or pinholes, cracking, etc. are apt to be formed on the coatings and there is a possibility that water and boiled rice soup penetrate through the pinholes or cracks and the corrosion of substrates, the peeling of the coatings, discoloration, etc. are caused. Secondly, indications are hard to see since the indications are provided by shadow made by recesses and protrusions.

Rice cookers have been intended to have multi-functions in recent years. Accordingly, on the inner pots of the rice cookers, not only a kind of marking for rice cooking but also many kinds of markings for rice to be boiled with red beans, rice gruel, glutinous rice, etc., for example, three or four kinds of markings have been required, and the number of markings has been increased so that the above-described problems have been actualized.

SUMMARY OF THE INVENTION

An object of the present invention is to solve the above-described prior art problems.

Other objects and effects of the present invention will be apparent from the following description.

The present invention relates to a fluororesin-coated material having markings indicated thereon which comprises (1) a substrate having coated thereon a fluororesin composition comprising a high-molecular weight material having a benzene ring and at least one of a nitrogen atom, a sulfur atom and a carbonyl group in the main chain thereof, or (2) a substrate having coated thereon the high-molecular weight material, and further having coated on the above high-molecular weight material a fluororesin composition. The markings are indicated on the coated material by irradiating the coated surface of the coated material with electromagnetic waves having a wavelength of 600 nm or less to thereby cause a change in the color of the high-molecular weight material at irradiated parts and provide a difference in color between the irradiated parts and unirradiated parts.

The term "marking" as used herein includes scales, patterns, letters, and the like.

DETAILED DESCRIPTION OF THE INVENTION

Figure 1:
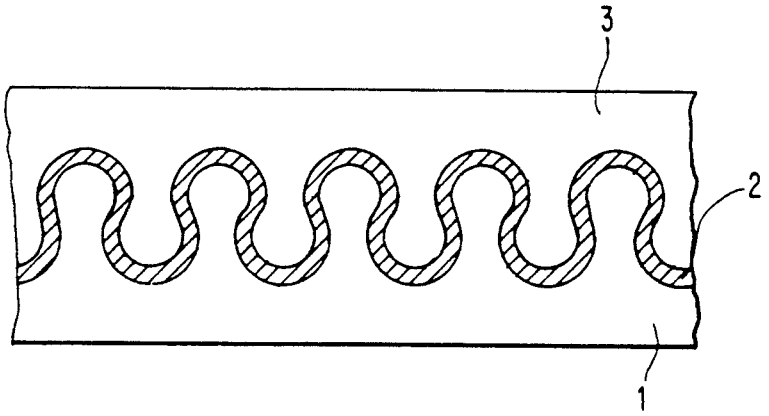
FIGS. 1 and 2 show each a schematic sectional view of a typical embodiment of a fluororesin-coated material according to the second invention.

A first embodiment of the present invention relates to a fluororesin-coated material having markings indicated thereon comprising a substrate having coated thereon a fluororesin composition comprising a high-molecular weight material having a benzene ring and at least one of a nitrogen atom, a sulfur atom and a carbonyl group in the main chain thereof, said markings being indicated on said coated material by irradiating the coated surface of said coated material with electromagnetic waves having a wavelength of 600 nm or less to thereby cause a change in the color of said high-molecular weight material at irradiated parts and provide a difference in color between said irradiated parts and unirradiated parts.

The above first embodiments of the present invention include the following preferred embodiments:

(a) In the fluororesin-coated material having markings indicated thereon according to the first embodiment of the present invention, the substrate is previously provided with markings composed of recesses and protrusions which are formed by pressing, and a change in color for indicating said markings caused by irradiation with electromagnetic waves on or not on said markings composed of recesses and protrusions.

(b) In the fluororesin-coated material having markings indicated thereon according to the first embodiment of the present invention, the high-molecular weight material is a polyimide polymer.

(c) In the fluororesin-coated material having markings indicated thereon according to the first embodiment of the present invention, the high-molecular weight material is a polyamideimide.

(d) In the fluororesin-coated material having markings indicated thereon according to the first embodiment of the present invention, the substrate has anchoring recesses and protrusions on the surface thereof on which said fluororesin composition is coated.

In the first embodiment of the present invention, the content of the high-molecular weight material having a benzene ring and at least one of a nitrogen atom, a sulfur atom and a carbonyl group in the main chain thereof is generally from 0.5 to 25 wt %, preferably from 0.5 to 10 wt %, and more preferably from 1 to 3 wt %, based on the total amount of the fluororesin composition. The thickness of the fluororesin composition layer is preferably from 5 to 50 μm, and more preferably from 10 to 40 μm.

A second embodiment of the present invention relates to a fluororesin-coated material having markings indicated thereon comprising a substrate having coated thereon a high-molecular weight material having a benzene ring and at least one of a nitrogen atom, a sulfur atom and a carbonyl group in the main chain thereof, and further having coated on said high-molecular weight material a fluororesin composition, said markings being indicated on said coated material by irradiating the coated surface of said coated material with electromagnetic waves having a wavelength of 600 nm or less to thereby cause a change in the color of said high-molecular weight material at irradiated parts and provide a difference in color between said irradiated parts and unirradiated parts.

The above second embodiments of the present invention include the following preferred embodiments:

(e) In the fluororesin-coated material having markings indicated thereon according to the second embodiment of the present invention, the substrate is previously provided with markings composed of recesses and protrusions which are formed by pressing, and a change in color for indicating said markings caused by irradiation with electromagnetic waves on or not on said markings composed of recesses and protrusions.

(f) In the fluororesin-coated material having markings indicated thereon according to the second embodiment of the present invention, the high-molecular weight material is a polyimide polymer.

(g) In the fluororesin-coated material having markings indicated thereon according to the second embodiment of the present invention, the high-molecular weight material is a polyamideimide.

(h) In the fluororesin-coated material having markings indicated thereon according to the second embodiment of the present invention, the substrate has anchoring recesses and protrusions on the surface thereof on which said high-molecular weight material is coated, and said high-molecular weight material is coated on said substrate in such a thickness as substantially not to loss said anchoring recesses and protrusions.

(i) In the fluororesin-coated material having markings indicated thereon according to the second embodiment of the present invention, the fluororesin composition contains said high-molecular weight material.

In the second embodiment of the present invention, the thickness of the layer of the high-molecular weight material having a benzene ring and at least one of a nitrogen atom, a sulfur atom and a carbonyl group in the main chain thereof is generally from 0.025 to 12.5 μm, preferably from 0.025 to 2.5 μm, and more preferably from 0.05 to 0.75 μm, and the thickness of the fluororesin composition layer is generally from 5 to 50 μm, and preferably from 10 to 40 μm. In the case where the fluororesin composition contains the high-molecular weight material, the content of the high-molecular weight material is preferably from 0.5 to 3 wt %, and more preferably from 0.5 to 1 wt %, based on the total amount of the fluororesin composition.

The present invention will be illustrated in more detail below.

The present inventors have eagerly made studies to solve the above-described problems associated with prior art. As a result, it has been found that when a material coated with a fluororesin containing a high-molecular weight material having a benzene ring as well as at least one of a nitrogen atom, a sulfur atom and a carbonyl group in its main chain is irradiated with electromagnetic waves having a wavelength of 600 nm or less, a change in the color of the irradiated parts are caused without lowering the physical properties such as non-tackiness, etc. of the surface of the fluororesin-coated material. It has been also found that scales, patterns, letters, etc. can be indicated by utilizing this phenomenon, that is, a difference in color between the irradiated part and the unirradiated part. The first embodiment of the present invention has been accomplished on the basis of this finding. Thus, since a change of color can be made without lowering physical properties such as surface non-tackiness, etc., indications can be made without deteriorating any characteristics of the coated materials, and indications can be attained which are easy to see in comparison with press-markings.

Further, the present inventors have found that when a coated material comprising a substrate laminated with a high-molecular weight material having a benzene ring and at least one of a nitrogen atom, a sulfur atom and a carbonyl group in its main chain and further coated thereon with a fluororesin composition is irradiated with electromagnetic waves having a wavelength of 600 nm or less, a change in the color of the irradiated parts of the high-molecular weight material is caused, whereby a difference in color between the irradiated part and the unirradiated part can be provided and scales, patterns, etc. can be indicated. The second embodiment of the present invention has been accomplished on the basis of this finding.

Figure 2:
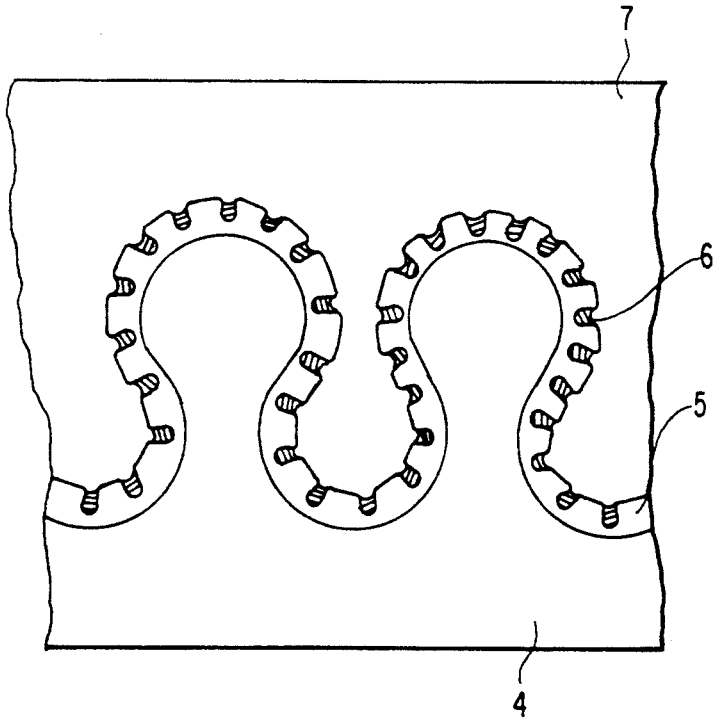

FIGS. 1 and 2 show each a schematic sectional view of one embodiment of a fluororesin-coated material according to the second embodiment of the present invention (electromagnetic wave irradiation is not shown). In FIG. 1, the numeral 1 is a substrate having anchoring recesses and protrusions, 2 is a polyamideimide layer having recesses and protrusions, and 3 is polytetrafluoroethylene (PTFE). In FIG. 2, the numeral 4 is an aluminum substrate having anchoring recesses and protrusions, 5 is a porous Alumite (aluminum oxide) layer having recesses and protrusions, 6 is a polyamideimide filled in the pores of the porous Alumite layer and 7 is PTFE.

In the second embodiment of the present invention, the high-molecular weight material layer may not form a uniform layer as in FIG. 1, but may be any form as long as the color of the high-molecular weight material become uniform as observed by the naked eye. For example, the high-molecular weight material may be filled in the pores of the substrate as in FIG. 2, and the high-molecular weight material may be partly adhered on the porous surface of the substrate.

The second embodiment of the present invention is different from the first embodiment of the present invention in that the high-molecular weight material layer for providing markings and the fluororesin layer are separately formed.

It is particularly preferred that the substrate for forming the high-molecular weight material layer has anchoring recesses and protrusions and the lamination of the high-molecular weight material is carried out so as substantially not to loss recesses and protrusions in the second embodiment.

The method for providing anchoring recesses and protrusions is not particularly limited, but the anchoring effect providing the adhesion strength of 2 kg/cm or more when polytetrafluoroethylene is coated is preferred. In general, the chemical or electrochemical etching method is preferably used although the physical method such as sand blast and grid blast may be used in combination. The adhesion strength of 2 kg/cm or more is generally not attained only by the physical method.

By providing anchoring recesses and protrusions, the fluororesin can be firmly integrated together with the substrate by anchoring effect on recesses and protrusions retained even after the formation of the high-molecular weight material layer. Hence, adhesive or the like is not always required, and formulations of the fluororesin composition can freely selected according to characteristics such as surface non-tackiness, wear resistance, etc. originally required for the fluororesin-coated material.

Further, the second embodiment can be attained by incorporating the high-molecular weight material in the fluororesin composition to improve adhesion between the high-molecular weight material and the fluororesin composition even when the substrate does not have anchoring recesses and protrusions or the anchoring recesses and protrusions are lost by the lamination of the high-molecular weight material.

In the first and second embodiments, press-markings can be used in combination with the indications according to the present invention. If indications are attained only by press-marking, deeper press-markings are necessary to obtain indications which are much easier to see. Deeper markings cause such a problem that the characteristics of the coating are greatly lowered as mentioned above. When markings having a depth which does not lower the physical properties of the coating are used in combination with the indications according to the present invention, indications which are much easier to see can be obtained and markings are left behind even if coating is worn.

Any of conventional high-molecular weight materials having a benzene ring as well as at least one of a nitrogen atom, a sulfur atom and a carbonyl group in its main chain can be used as the high-molecular weight material to be contained in the fluororesin composition used in present invention (first embodiment) or the high-molecular weight material to be laminated onto the substrate used in the present invention (second embodiment). Examples of the high-molecular weight materials include imide polymers such as polyimides, polyamideimides, polyparabanic acid and polyether imides; sulfone polymers such as polysulfone, polyether sulfones and polyaryl sulfones; and polyphenylene sulfide, polyether ether ketones, and polyoxybenzoyl. Among these polymers, polyimide polymers are preferable, because they are excellent in heat resistance and a difference in color can be easily obtained. Particularly, polyamideimides are preferred.

The method for providing the high-molecular weight material layer is not particularly limited. For example, a solution of the high-molecular weight material is coated on the substrate and then dried; a solution of the starting materials for forming the high-molecular weight material is coated and dried, and then reacted with heat to form the high-molecular weight material; an aqueous dispersion of the high-molecular weight material is coated and dried, and then fuse-adhered by heating; and a layer is provided by sputtering or coating powder of the high-molecular weight material, and then fuse-adhered by heating.

When a material coated with a fluororesin containing the high-molecular weight material (first embodiment) or the high-molecular weight material laminated with a fluororesin (second embodiment) is irradiated with electromagnetic waves having a wavelength of 600 nm or less, the high-molecular weight material in the irradiated parts absorbs electromagnetic waves and is modified and as a result, a change in color is caused. The wavelength of the electromagnetic waves somewhat varies depending on the molecular structures of the high-molecular weight materials, particularly the types of functional groups and bonds which absorb electromagnetic wave, but is preferably 600 nm or less and 200 nm or more. The irradiated amount of the electromagnetic wavce is preferably 0.5 $Wh/cm^2$ or more, and more preferably 2 $Wh/cm^2$ or more.

Examples of the source of the electromagnetic wave which are easy to handle include, but are not limited to, an ultraviolet lamp such as a xenon lamp, a mercury vapor lamp and a laser. A laser is particularly preferred, because high-density energy can be easily obtained so that the coated material can be treated in a short time.

Any of conventional fluororesins can be used in the fluororesin composition of the present invention. Examples of the fluororesin which can be used in the present invention include polytetrafluoroethylene (PTFE), tetrafluoroethylene-hexafluoropropylene copolymer (PEP), tetrafluoroethylene-perfluoroalkyl vinyl ethers (PFA), ethylene-tetrafluoroethylene copolymer (ETFE), polychlorotrifluoroethylene (PCTFE) and ethylene-chlorotrifluoroethylene copolymer (ECTFE).

The fluororesins can be used in the forms of resin powder as well as an aqueous dispersion of emulsion-polymerized fluororesin, a dispersion of fluororesin powder in an aqueous medium, an organosol of fluororesin and an aqueous emulsion of organosol.

The method for providing the fluororesin composition layer is not particularly limited. For example, an aqueous dispersion or powder of the fluororesin composition is coated and dried, and then sintered by heating.

When the substrate does not have recesses and protrusions to such a degree that the resin coating can be bonded to the substrate by an anchoring effect or when recesses and protrusions are substantially lost by the lamination of the high-molecular weight material, adhesion at the interface between the high-molecular weight material layer and the fluororesin layer may be insufficient and peeling, etc. are caused. In such a case, the high molecular weight material layer and the fluororesin layer can be firmly bonded to each other if the same high-molecular weight material as that used in the high-molecular weight material layer is previously blended with the fluororesin composition. Accordingly, a substrate which does substantially not have recesses and protrusions as described above can be used.

In the fluororesin composition layer, a pigment may be added. For example, carbon may be added in an amount of from 0.1 to 5 parts by weight, titanium oxide may be added in an amount of from 0.1 to 20 parts by weight, and mica or pigment-coated mica may be added in an amount of from 0.1 to 5 parts by weight per 100 parts by weight of the fluororesin composition, provided that the total amount of the pigment is preferably 20 parts by weight or less per 100 parts by weight of the fluororesin composition.

The present invention is now illustrated in greater detail by reference to the following examples which, however, are not to be construed as limiting the invention in any way.

EXAMPLE 1

The surface of an etched aluminum sheet was coated with a fluororesin composition having a composition given in Table 1. After drying and sintering, the resulting sheet was press-molded to obtain a pot. A mask made of aluminum from which letters were punched into the blank was applied to the inner pot. The pot was then irradiated with electromagnetic wave having a wavelength of 300 to 600 nm at a power density of 100 $mW/cm^2$ from an ultraviolet lamp for about 3 hours.

The irradiated letter parts became white silver color, while the ground had light brownish bronze luster. Accordingly, the indications of letters, which were easy to see could be obtained. No change in surface non-tackiness was caused.

EXAMPLES 2 and 3

First Embodiment

The surface of an etched aluminum sheet was coated with a fluororesin composition having a composition given in Table 1. After drying and sintering, the resulting sheet was press-molded to obtain a pot. A mask made of aluminum from which letters were punched into the blank was applied to the inner pot. The pot was irradiated with an excimer laser having a wavelength of 308 nm at 100 $W/cm^2$ for 15 seconds.

The irradiated letter parts became white silver color, while the ground had light brown luster. Accordingly, the indications of letters, which were easy to see could be obtained. No change in surface non-tackiness was caused.

TABLE 1

| | Example No. | | | |
|---|---|---|---|---|
| Composition (wt %) | Ex. 1 | Ex. 2 | Ex. 3 | Comp. Ex. 2 |
| PTFE | 36 | 36 | 36 | 40 |
| Mica | 2 | — | — | 2 |
| Polyamideimide | 1 | 2 | — | — |
| Polyether sulfone | — | — | 2 | — |
| Carbon | 1 | 1 | 1 | 1 |
| Surfactant (polyoxyethylene nonylphenyl ether) | 7 | 7 | 7 | 7 |
| Water | 53 | 54 | 54 | 50 |

COMPARATIVE EXAMPLE 1

The procedure of Example 1 was repeated except that irradiation with infrared rays having a wavelength of 3 to 30 μm and of 100 W was carried out for about 3 hours. No change of color was observed and the indications of letters could not be made.

COMPARATIVE EXAMPLE 2

The procedure of Example 1 was repeated except that a fluororesin composition having a composition given in Table 1 was used. No change in color was observed and the indications of letters could not be made.

EXAMPLE 4

First Embodiment

The surface of an aluminum sheet was electrochemically etched to provide fine recesses and protrusions on the surface thereof. The surface of the etched aluminum sheet was coated with a fluororesin composition consisting of 36% by weight of PTFE, 2% by weight of mica, 1% by weight of polyamideimide, 1% by weight of carbon, 7% by weight of a surfactant (polyoxyethylene nonylphenyl ether) and 53% by weight of water. The coated aluminum sheet was dried and sintered by heating at 430° C. for 20 minutes to obtain a coated sheet.

The coated sheet was press-molded into a pot. A water level scale was press-marked on the side surface thereof so as to give a protrusion of about 0.5 mm in height toward cooking side. A mask made of aluminum, from which the same pattern as the water level scale was punched into the blank was brought into closely contact with the water level scale part. Further, other parts were completely covered with a metallic film so that the mask was applied so as to allow only the water level scale in the coated surface of the pot to be exposed.

The masked pot was irradiated with an ultraviolet lamp (wavelength: 200 to 600 nm) at a power density of 10 $mW/cm^2$ for about 3 hours.

When the mask was removed, the indication of white silver scale which was easy to see was obtained only at the protruded marked part, while the ground had light brownish bronze luster. It was found that the scale indication part had good non-tackiness as well as good corrosion resistance.

EXAMPLE 5

Second Embodiment

An aluminum sheet was electrochemically etched. Further, an Alumite layer of about 0.5 μm in thickness was formed thereon. The surface thereof was coated with a 1 wt % polyamideimide solution in a liquid thickness of about 30 μm. The coated sheet was dried at 200° C. for 30 minutes.

The surface of the resulting coated sheet was coated with a fluororesin dispersion consisting of about 60% by weight of PTFE, a surfactant and water. After drying, the coated sheet was sintered at 420° C. for 4 minutes to form a PTFE coat of about 25 μm in thickness.

The resulting fluororesin-coated material was press-molded into a pot. The fluororesin coat had good adhesion and was not peeled off by press molding.

A mask made of aluminum, from which letters were punched into the blank was applied to the inner wall of the pot. The pot was irradiated with ultraviolet light having a wavelength of 200 to 600 nm at a power density of 2 $W/cm^2$ for about 60 minutes.

While the ground was light brown, the irradiated letter parts became while silver color and there could be obtained the indications of letters which were easy to see. The surface non-tackiness was good and not different from that of natural PTFE.

EXAMPLE 6

Second Embodiment

A pot made of white ceramics, which had fine recesses and protrusions was coated with a 2 wt % polyamideimide solution in a liquid thickness of about 10 μm, and dried at about 200° C. for 30 minutes. Further, the coated surface was coated with a fluororesin dispersion consisting of about 60% by weight of PTFE, a surfactant and water in a thickness of about 40 μm. After drying, the coated material was sintered at 420° C. for 4 minutes to form a PTFE coat of 25 μm in thickness.

A mask made of aluminum, from which letters were punched into the blank was applied to the inner wall of the pot. The pot was irradiated with ultraviolet light having a wavelength of 200 to 600 nm at a power density of 2 W/cm$^2$.

While the ground was brown, the irradiated letter parts became white and there could be obtained the indications of letters which were easy to see. Surface non-tackiness was good as in Example 1.

EXAMPLE 7

Second Embodiment

A mechanically blasted aluminum sheet was coated with a 2 wt % polyamideimide solution in a thickness of about 10 μm and then dried at about 200° C. for 30 minutes. The coated sheet was then coated with a fluororesin dispersion consisting of about 60% by weight of PTFE, about 4% by weight of polyamideimide, a surfactant and water in a thickness of about 30 μm. After drying, the resulting coated material was sintered at 420° C. for 5 minutes to form a coat of about 20 μm in thickness.

The resulting sheet was press-molded into a pot. The indications of scales were made in the form of recesses by press-markings. The pot excluding the marking parts was covered with a mask made of aluminum and irradiated with ultraviolet light having a wavelength of 200 to 600 nm at a power density of 2 W/cm$^2$. There could be obtained the indications of white silver scales in a recessed form, which were easy to see.

All the substances used in Examples and Comparative Examples were those commercially available in the art.

According to the present invention, the indications of markings, such as scales, patterns, letters, etc., can be made without deteriorating any of the characteristics of the fluororesin coating of the fluororesin-coated material such as the inner pot of rice cooking jar, and the indications are easy to see in comparison to the conventional press-markings. Accordingly, the present invention can be widely used for indicating, for example, scales and operating instructions of kitchen utensils, and for preparing patterns thereof.

Further, the shape of the fluororesin-coated material of the present invention is not limited to the above-described shape, but can be applied to finished articles such as the inner pots of rice cooking jars or fluororesin-coated sheets.

While the present invention has been described in detail and with reference to specific embodiments thereof, it is apparent to one skilled in the art that various changes and modifications can be made therein without departing from the spirit and the scope of the present invention.

What is claimed is:

1. A fluororesin-coated material having markings indicated thereon comprising a substrate having coated thereon a composition comprising a fluororesin and a high-molecular weight material having a benzene ring and at least one of a nitrogen atom, a sulfur atom and a carbonyl group in the main chain thereof, said markings having been indicated on said coated material by irradiating the coated surface of said coated material with electromagnetic waves having a wavelength of 600 nm or less to cause a change in the color of said high-molecular weight material at irradiated parts and provide a difference in color between said irradiated parts and unirradiated parts.

2. A fluororesin-coated material having markings indicated thereon as claimed in claim 1, wherein said substrate has anchoring recesses and protrusions on the surface thereof on which said fluororesin composition is coated.

3. A fluororesin-coated material having markings indicated thereon as claimed in claim 1, wherein said substrate is previously provided with markings composed of recesses and protrusions which are formed by pressing, and a change in color for indicating said markings caused by irradiation with electromagnetic waves on or not on said markings composed of recesses and protrusions.

4. A fluororesin-coated material having markings indicated thereon as claimed in claim 1, wherein said high-molecular weight material is a polyimide polymer.

5. A fluororesin-coated material having markings indicated thereon as claimed in claim 4, wherein said high-molecular weight material is a polyamideimide.

6. A fluororesin-coated material having markings indicated thereon comprising a substrate having coated thereon a high-molecular weight material having a benzene ring and at least one of a nitrogen atom, a sulfur atom and a carbonyl group in the main chain thereof, and further having coated on said high-molecular weight material a fluororesin composition, said markings having been indicated on said coated material by irradiating the coated surface of said coated material with electromagnetic waves having a wavelength of 600 nm or less to cause a change in the color of said high-molecular weight material at irradiated parts and provide a difference in color between said irradiated parts and unirradiated parts.

7. A fluororesin-coated material having markings indicated thereon as claimed in claim 6, wherein said substrate is previously provided with markings composed of recesses and protrusions which are formed by pressing, and a change in color for indicating said markings caused by irradiation with electromagnetic waves on or not on said markings composed of recesses and protrusions.

8. A fluororesin-coated material having markings indicated thereon as claimed in claim 6, wherein said high-molecular weight material is a polyimide polymer.

9. A fluororesin-coated material having markings indicated thereon as claimed in claim 8, wherein said high-molecular weight material is a polyamideimide.

10. A fluororesin-coated material having markings indicated thereon as claimed in claim 6, wherein said substrate has anchoring recesses and protrusions on the surface thereof on which said high-molecular weight material is coated, and said high-molecular weight material is coated on said substrate in such a thickness as substantially not to lose said anchoring recesses and protrusions.

11. A fluororesin-coated material having markings indicated thereon as claimed in claim 6, wherein said fluororesin composition contains said high-molecular weight material.

* * * * *